US006531089B1

(12) United States Patent
Brungs et al.

(10) Patent No.: US 6,531,089 B1
(45) Date of Patent: Mar. 11, 2003

(54) ALLOY AND METHOD FOR PRODUCING OBJECTS THEREFROM

(75) Inventors: Dieter Brungs, Meschede (DE); Heinrich Fuchs, Meschede (DE); Meinolf Hengesbach, Meschede (DE); Franz Reinken, Warstein (DE)

(73) Assignee: Honsel GmbH & Co. KG (DE)

( * ) Notice: Subject to any disclaimer, the term of this patent is extended or adjusted under 35 U.S.C. 154(b) by 0 days.

(21) Appl. No.: 09/486,511

(22) PCT Filed: Aug. 7, 1998

(86) PCT No.: PCT/EP98/05017

§ 371 (c)(1),
(2), (4) Date: May 8, 2000

(87) PCT Pub. No.: WO99/11834

PCT Pub. Date: Mar. 11, 1999

(30) Foreign Application Priority Data

Aug. 30, 1997 (DE) ..... 197 37 957
Jan. 20, 1998 (DE) ..... 198 01 941

(51) Int. Cl.[7] ..... C22C 1/04
(52) U.S. Cl. ..... 419/28; 419/29
(58) Field of Search ..... 75/236, 249; 420/548, 420/534; 419/28, 29

(56) References Cited

U.S. PATENT DOCUMENTS 3,765,877 A * 10/1973 Sperry et la. ..... 75/142
4,969,428 A * 11/1990 Donahue et al. ..... 123/195 R
5,234,514 A * 8/1993 Donahue et al. ..... 148/549
5,366,691 A * 11/1994 Takeda et al. ..... 420/548
5,405,576 A * 4/1995 Kusui et al. ..... 420/534
5,851,320 A * 12/1998 Auran et al. ..... 148/552

FOREIGN PATENT DOCUMENTS

| | | |
|---|---|---|
| DE | 19532244 | 3/1997 |
| EP | 0411577 | 2/1991 |
| EP | 0529520 | 3/1993 |
| EP | 0601694 | 6/1994 |
| EP | 0669404 | 8/1995 |
| EP | 0864660 | 9/1998 |
| JP | 59-020444 | 2/1984 |
| JP | 60-050137 | 3/1985 |
| JP | 60-050138 | 3/1985 |
| JP | 8-218141 | 8/1996 |

* cited by examiner

*Primary Examiner*—Daniel J. Jenkins
(74) *Attorney, Agent, or Firm*—Ostrolenk, Faber, Gerb & Soffen, LLP

(57) ABSTRACT

Aluminum alloy containing a fraction of uniformly distributed particles, preferably silicon particles, of less than 20% by weight, so as to increase the wear resistance, prior to processing or machining under hot conditions, and process for producing wear-resistant objects from such an aluminum alloy.

9 Claims, No Drawings

ALLOY AND METHOD FOR PRODUCING OBJECTS THEREFROM

The invention relates to an alloy containing a fraction of particles and to a process for producing objects from such an alloy, in particular with an addition of particles in an aluminum alloy, so as to increase the wear resistance.

Aluminum alloys with a fraction of particles, in particular in the form of primary silicon crystals, which increase the wear resistance are known, for example, as hypereutectic aluminum-silicon casting alloys. These alloys can be used to cast, for example, entire engine blocks or alternatively cylinder liners. The primary silicon crystals precipitate out during cooling. The wear resistance of, for example, the running surface is provided by the precipitated, harder primary silicon crystals, which are exposed at the surface by special treatment processes, in particular etching processes. A drawback of these hypereutectic aluminum-silicon casting alloys is that the primary silicon crystals are in the form of sharp-edged, sometimes acicular crystals and in different sizes and distributions depending on the solidification rate, so that machining requires special tools in order to keep the wear caused by the hard primary silicon crystals within acceptable limits.

Producing entire cylinder blocks from a hypereutectic aluminum-silicon alloy is expensive, since this material requires increased outlay during casting and, as mentioned above, high machining outlay owing to the precipitated primary silicon crystals.

In order to avoid these difficulties in machining large castings, it is also already known, for example, to fit, in particular by casting, cylinder linings made from a hypereutectic aluminum-silicon alloy in a cylinder block produced from a conventional, readily castable aluminum alloy.

While the wear-resistant, hypereutectic aluminum-silicon casting alloys for cylinder blocks normally have a silicon content of about 17% by weight, the separately produced cylinder liners may have silicon contents of from 20 to 30% by weight, in which case, for example, initially a billet is produced by spray compacting of a hypereutectic aluminum-silicon alloy or by powder metallurgy from a powder of such a hypereutectic aluminum-silicon alloy, and then the liner is produced from this billet by hot extrusion. These hypereutectic aluminum-silicon alloys, and the processes for producing cylinder liners, are described in German Patent 43 28 619 and German laid-open specification 44 38 550.

If only the cylinder liners are produced from a wear-resistant, hypereutectic aluminum-silicon alloy, a drawback of both the spray compacting of a hypereutectic aluminum-silicon alloy and the powder metallurgy process is that billets which consist entirely of a hypereutectic aluminum-silicon content of up to 30% by weight, the intermetallic phases and the primary silicon crystals which bring about the wear resistance crystallize out of the molten hypereutectic material during cooling and consequently have the sharp-edged and acicular shapes which are typical of primary silicon crystals. In order to reduce the wear on pistons sliding inside the cylinders of such engine blocks caused by these primary crystals and intermetallic phases, it is proposed, according to German Patent Application 44 38 550, for the primary silicon crystals and particles from intermetallic phases to be exposed by means of precision machining and to change the edges of the exposed surfaces of the primary crystals or particles into a convex or rounded shape in the base alloying material.

By contrast, the invention is based on the problem of providing an aluminum alloy, and a process for producing objects from such an alloy which avoid the abovementioned drawbacks, i.e. are easy to process and machine, in particular by hot-forming and/or metal-removing machining, while nevertheless having the required wear resistance and/or uniform structure and mechanical strength, for example.

One solution to this problem is an aluminum alloy which, in a matrix of readily processable and machinable aluminum alloy, have an addition of uniformly distributed particles, preferably silicon particles, or of particles of a hypereutectic aluminum-silicon alloy, the individual particles having high silicon contents, preferably up to 50% by weight, while the silicon content in the readily processable and machinable aluminum alloy, but at most 12% by weight. As an alternative to silicon, it is also possible to add other hard particles, e.g. particles of silicon carbide, to the readily processable and machinable aluminum alloy.

The invention is based on the insight that the silicon, which is readily soluble in molten aluminum, has to be prevented from dissolving in the matrix, since the relatively large sharp-edged and acicular crystals, which increase the wear, are formed when primary silicon crystals precipitate out of the solution. Therefore, if a readily processable and machinable aluminum alloy is mixed with uniformly distributed silicon particles and/or silicon carbide particles and/or aluminum oxide particles and/or with particles of a hypereutectic aluminum-silicon alloy in such a way that undissolved silicon particles and/or silicon carbide particles and/or aluminum oxide particles and/or primary silicon crystals remain in the particles of the hypereutectic aluminum-silicon alloy in the aluminum alloy, it is also impossible for these silicon particles, silicon carbide particles or primary silicon crystals, which were originally introduced and have not dissolved in the readily processable and machinable aluminum alloy matrix, to return to the disadvantageous forms produced when they crystallize out, and instead they maintain their original form or may even be rounded by superficial dissolution, so that they lose their pronounced points and corners.

The decisive factor for the invention is that the matrix comprising the readily processable and machinable aluminum alloy be composed in such a way that it is impossible for any primary silicon crystals to crystallize out of this aluminum alloy and in such a way that finely distributed silicon particles, silicon carbide particles or particles of a hypereutectic aluminum-silicon alloy containing primary silicon crystals are present without having dissolved in the matrix alloy.

Therefore, the matrix alloy as a whole does not have to be hypereutectic in order to contain silicon particles, as is required in the case of the known wear-resistant aluminum-silicon alloys, but rather may preferably contain an addition of at most 12% by weight of silicon in the form of silicon particles and/or primary silicon crystals in the particles of the hypereutectic aluminum-silicon alloy, provided that the aluminum alloy which is processed to form an object contains a minimum level of silicon particles and/or particles of a hypereutectic aluminum-silicon alloy which contain primary silicon crystals, preferably at least 5% by weight of silicon particles and/or primary silicon crystals in the particles of the hypereutectic aluminum silicon alloy, based on the total quantity, since it has been established that such a level of silicon particles which have not precipitated out of the matrix alloy or of primary silicon crystals is sufficient to achieve the desired wear resistance.

The amount of silicon particles and/or aluminum oxide particles in the matrix alloy is preferably 5 to 20%.

Preferably, the matrix alloy, as a hot-formable wrought aluminum alloy, may, for example, have a composition of the AlMgSiCu type and may be provided with an addition of uniformly distributed silicon particles and/or particles of a hypereutectic aluminum-silicon alloy of less than 20% by weight, based on the total quantity prior to hot-forming. Wrought aluminum alloys are readily hot-formable alloys whose hot-formability is also not destroyed by the addition of silicon particles or of particles of a hypereutectic aluminum-silicon alloy. This addition of uniformly distributed silicon particles or of particles of a hypereutectic aluminum-silicon alloy may be relatively high, in particular if some of these silicon particles or the particles of a hypereutectic aluminum-silicon alloy dissolve during hot-forming and/or heat treatment. It is, however, important that a residual fraction of uniformly distributed, undissolved silicon particles and/or of primary silicon crystals in the particles of a hypereutectic aluminum-silicon alloy, preferably of at least approximately 5% by weight based on the total quantity, is retained, these silicon particles or the primary silicon crystals in the particles of a hypereutectic aluminum-silicon alloy being present without pronounced points and corners. It is possible that heat treatment or hot-forming may cause superficial and partial dissolution of the silicon particles or of the particles of a hypereutectic aluminum-silicon alloy, while the undissolved silicon particles or primary silicon crystals of the particles of a hypereutectic aluminum-silicon alloy are present in a fraction of preferably at least approximately 5% by weight and do not have any pronounced points and corners.

The grain size of the silicon particles in the aluminum alloy is preferably at most 80 $\mu$m, the grain size of the particles of a hypereutectic aluminum-silicon alloy is preferably at most 250 $\mu$m, while the size of the primary silicon crystals in the particles of the hypereutectic aluminum-silicon alloy is at most 20 $\mu$m.

To solve the problem mentioned above, the invention also proposes a process for producing objects, in particular wear-resistant objects, from an aluminum alloy, in which a billet is produced by spray compacting of a molten aluminum alloy and silicon particles and/or particles of a hypereutectic aluminum-silicon alloy are added to the aluminum alloy in the spray jet in a proportion of less than 20% by weight, based on the total quantity. The sprayed molten aluminum alloy may be of a composition which is suitable for spray compacting and subsequent further treatment by metal-removing forming or by hot-forming, while the particles of a hypereutectic aluminum-silicon alloy and/or the silicon particles supplied to the spray jet are absorbed by the molten aluminum alloy in the spray jet and may also be superficially or partially dissolved therein wear-resistant objects from a hot-formable aluminum alloy in which a billet or compact is produced from alloy powder or a mixture of powder of various alloying constituents with an addition of uniformly distributed silicon particles and/or of particles of a hypereutectic aluminum-silicon alloy of at most 12% by weight, based on the total quantity, and this billet or compact is-then hot-formed, is particularly advantageous.

Powder metallurgy makes it possible to produce aluminum alloys of any desired composition from a mixture of powders of various alloying constituents which are homogenized by subsequent hot-forming. If, according to the invention, uniformly distributed silicon particles and/or particles of a hypereutectic aluminum-silicon alloy in a proportion of at most 12% by weight, based on the total quantity, are added to this mixture, the silicon particles or the particles of a hypereutectic aluminum-silicon alloy, during the subsequent hot-forming, as described above are uniformly distributed and may be superficially or partially dissolved, so that ultimately, in the hot-formed object, there are preferably at least 5% by weight, based on the total quantity, of uniformly distributed, undissolved silicon particles and/or primary silicon crystals in the particles of a hypereutectic aluminum-silicon alloy, which do not have the points and corners of primary silicon crystals which have precipitated out of a hypereutectic molten alloy but do, in the same way, produce the wear resistance of the aluminum alloy, which in this case may preferably be in the form of a hot-formable wrought aluminum alloy, for example of the composition AlMgSiCu.

The hot-forming of the billet or compact may, for example, be carried out by hot-rolling or hot extrusion to form bars, tubes and sections or by hot pressing, with any subsequent heat treatment serving mold and to carry out sintering under a pressure and at a temperature which are such that the required strength is achieved and the minimum level of silicon particles or primary silicon crystals in the particles of a hypereutectic aluminum-silicon alloy is present. In this case too, a further heat treatment may follow if required.

All the sections of the process which are carried under hot conditions are to be adapted to one another in such a way that the desired properties are produced by the machining and processing heat and/or the heat treatment and, in any case, there are residual undissolved silicon particles or primary silicon crystals in the particles of a hypereutectic aluminum-silicon alloy, preferably in a fraction of approximately 5% by weight, based on the total quantity.

It is possible for the silicon particles or the particles of a hypereutectic aluminum-silicon alloy to be added preferably with a hypoeutectic level of the matrix alloy, if it is ensured that a silicon fraction in the form of silicon particles and/or of primary silicon crystals in the particles of a hypereutectic aluminum-silicon alloy is maintained, preferably at a level of approximately 5% by weight, based on the total quantity.

A particular advantage of the aluminum alloy according to the invention and the production processes is that any desired alloying composition to which the silicon particles or the particles of a hypereutectic aluminum-silicon alloy are added in the manner according to the invention, without fully dissolving, are possible, so that these added silicon particles or the particles of a hypereutectic aluminum-silicon alloy or the primary silicon crystals which are present therein remain undissolved in the matrix alloy and thus there are no primary silicon crystals precipitated out of the matrix alloy. This contrasts with the known hypereutectic alloys, in which primary silicon crystals which have a sharp-edged or sharp-cornered and acicular form, are precipitated out of the molten material during cooling. In addition, in the case of the hypereutectic alloys, a heat treatment increases the grain size, with needle formation, which is a drawback in terms of the wear caused by the material.

By contrast, the silicon particles or particles of a hypereutectic aluminum-silicon alloy which are added to the matrix alloy according to the invention are at most superficially dissolved and substantially retain their original form during a heat treatment, even if the silicon fraction in the form of the silicon particles and/or primary silicon crystals in the particles of a hypereutectic aluminum-silicon alloy amounts to no more than approximately 12% by weight, based on the total quantity, corresponding to the aluminum-silicon eutectic.

Wear-resistant objects produced using the process according to the invention can, for example, be cast into a readily castable aluminum alloy, which is particularly suitable for casting cylinder blocks and is readily machinable, as wear-resistant cylinder liners, and further machining of the cylinder liners which have been cast in may no longer be necessary if they have been produced from hot-mold or hot-extruded starting material and slugs produced therefrom by hot pressing. A sufficient material-to-material bond between the cast aluminum alloy for the cylinder block and the cast-in cylinder liners according to the invention can be achieved using the process described in German Patent 43 28 619, without it being possible to detect significant drawbacks when using billets or compacts which have been produced by powder metallurgy and were subsequently hot-formed. Any surface treatment of the cylinder liners by etching which may be required does not change the dimensional accuracy, but merely serves to expose the rounded silicon particles or primary silicon crystals from the added particles of a hypereutectic aluminum-silicon alloy.

The aluminum alloy according to the invention may also be used, for example, to produce pistons, hydraulic or pneumatic working cylinders and for planar slideways.

What is claimed is:

1. A method of manufacturing cylinder liners and hydraulic or pneumatic working cylinders comprising the steps of:

preparing an aluminum alloy consisting of a readily hot-deformable wrought aluminum alloy matrix of the type Al Mg Si Cu with a composition out of which no silicon primary crystals can crystallize, with a finely dispersed wear-resistance-increasing addition of at least one of uniformly distributed silicon particles and particles of a hypereutectic aluminum/silicon alloy, the individual particles of the hypereutectic aluminum silicon alloy having high silicon contents and the addition is at most 12% by weight silicon of the total silicon content of the aluminum alloy in the form of silicon particles and/or of silicon primary crystals in the particles of the hypereutectic aluminum/silicon alloy, preventing at least part of the silicon particles and/or primary crystals in the particles of the hypereutectic aluminum/silicon alloy from going into solution in the aluminum alloy matrix, preparing a billet from the alloy, hot deforming the billet by hot flow pressing into the cylinder liner or hydraulic or pneumatic working cylinder close to their final dimensions, wherein, the hot deforming step is controlled in such a way that the aluminum alloy which is processed into the cylinder liner or hydraulic or pneumatic working cylinder, after hot deformation and a subsequent optional heat treatment step, has a minimum content of silicon particles and/or silicon primary crystals which have not dissolved and have not separated out from the matrix alloy in the particles of the hypereutectic aluminum/silicon alloy relative to the total quantity of at least 5% by weight.

2. The method of claim 1, wherein the hypereutectic alloy particles contain up to 50 weight % silicon.

3. The method of claim 1, wherein the grain size of the silicon particles is at least 80 $\mu$m, the grain size of the particles of a hypereutectic aluminum/silicon alloy is at most 250 $\mu$m and of the silicon primary crystals in the particles of the hypereutectic aluminum/silicon alloy is at most 20 $\mu$m.

4. The method of claim 1, in which the billet is produced by spray-compacting a melt of the aluminum alloy matrix and to which silicon in the form of silicon particles and/or silicon primary crystals in the particles of a hypereutectic aluminum/silicon alloy is added in the spray jet of at most 12% weight relative the total quantity and this billet is then hot deformed by hot flow pressing.

5. The method of claim 1, in which the billet is produced from a matrix alloy powder with an addition of uniformly distributed silicon particles and/or of silicon primary crystals in particles of hypereutectic aluminum/silicon alloy of at most 12% weight relative to the total quantity and this billet is then hot-deformed by hot flow pressing.

6. The method of claim 1, in which the billet is produced from a mixture of powders of differing alloying constituents corresponding to the readily hot deformable wrought aluminum alloy matrix with an addition of silicon in the form of uniformly distributed silicon particles and/or silicon primary crystals in particles of a hypereutectic aluminum/silicon alloy of at most 12% by weight relative to the total quantity and this bar is then hot-deformed by hot flow pressing.

7. The method of claim 5, in which the billet in the form of a solid round compact or a hollow round compact is produced form the powder by hydrostatic pressing, is heated up and then is processed further by hot flow-pressing.

8. The method of claim 5, in which the powder consisting of an aluminum alloy or alloying constituents and silicon particles or particles of a hypereutectic aluminum/silicon alloy is placed in a heated hot flow-pressing mould, is hydrostatically pressed with the mould closed into a billet and then is hot flow-pressed once the mould has been opened.

9. The method of claim 5, in which the powder consisting of an aluminum alloy or alloying constituents and silicon particles and/or particles of hypereutectic aluminum/silicon alloy is placed in a mould and is sintered under pressure and at elevated temperature into a billet which is then processed further but not flow-pressing.

* * * * *